United States Patent [19]

Redmerski et al.

[11] Patent Number: 4,942,922

[45] Date of Patent: Jul. 24, 1990

[54] WELDED CORROSION-RESISTANT FERRITIC STAINLESS STEEL TUBING HAVING HIGH RESISTANCE TO HYDROGEN EMBRITTLEMENT AND A CATHODICALLY PROTECTED HEAT EXCHANGER CONTAINING THE SAME

[75] Inventors: Lawrence S. Redmerski, McKees Rocks; Kenneth E. Pinnow, Pittsburgh; John J. Eckenrod, Coraopolis, all of Pa.

[73] Assignee: Crucible Materials Corporation, Pittsburgh, Pa.

[21] Appl. No.: 259,520

[22] Filed: Oct. 18, 1988

[51] Int. Cl.[5] ..... F28F 21/08

[52] U.S. Cl. ..... 165/134.1; 138/177; 148/325; 148/909; 165/905; 420/69

[58] Field of Search ..... 138/177; 148/325, 909; 165/134.1, 905; 420/69

[56] References Cited

U.S. PATENT DOCUMENTS 4,119,765 10/1978 Pinnow ..... 420/69 X
4,360,381 11/1982 Tarutani ..... 420/69 X
4,570,708 2/1986 Tiberg ..... 148/909 X
4,726,853 2/1988 Gressin ..... 420/69 X

*Primary Examiner*—Robert G. Nilson
*Attorney, Agent, or Firm*—Finnegan, Henderson, Farabow, Garrett & Dunner

[57] ABSTRACT

Welded ferritic stainless steel tubing having high resistance to hydrogen embrittlement particularly adapted for use in heat exchangers handling chemical media containing hydrogen sulfide or nascent hydrogen and in cathodically protected heat exchangers. The ferritic stainless steel of the welded tubing consists essentially of, in weight percent, carbon at least 0.002, nitrogen at least 0.002, carbon plus nitrogen 0.02 max. and preferably 0.01 to 0.02, chromium 23 to 28, preferably 25 to 28, manganese up to 1, preferably up to 0.5, nickel 1 to 4, silicon up to 1, preferably up to 0.5, phosphorus up to 0.04, sulfur up to 0.02, preferably up to 0.005, molybdenum 2 to 5, preferably 2 to 4, aluminum up to 0.1, columbium 0.60 max. with columbium being at least equal to eight times carbon plus nitrogen, and the balance iron and incidental impurities.

24 Claims, No Drawings

WELDED CORROSION-RESISTANT FERRITIC STAINLESS STEEL TUBING HAVING HIGH RESISTANCE TO HYDROGEN EMBRITTLEMENT AND A CATHODICALLY PROTECTED HEAT EXCHANGER CONTAINING THE SAME

BACKGROUND OF THE INVENTION

1. Field of the Invention

The invention relates to welded tubing of a highly corrosion resistant ferritic stainless steel characterized by high resistance to hydrogen embrittlement. The tubing is adapted for use in heat exchangers handling process media containing hydrogen sulfide and other sources of nascent hydrogen, in cathodically protected heat exchangers, and in particular for cathodically protected heat exchangers operated at electrochemical potentials more negative than about −800 millivolts with respect to the saturated calomel reference electrode (SCE).

2. Description of the Prior Art

Heat exchangers and condensers are devices used to transfer heat from one medium to another. In the shell and tube type heat exchangers hot liquid or vapor is contained in the shell while the cool liquid passes through the tubes. For reasons of performance and economy, many electrical power plant condensers and chemical and petrochemical plant heat exchangers are now built with highly alloyed ferritic stainless steel tubing and with dissimilar metal tubesheets and water boxes. This practice is particularly common in rebuilt condensers or heat exchangers in which ferritic stainless steel tubing has been used to replace copper alloy tubing installed in tubesheets of matching or nearly matching compositions. Condensers and heat exchangers of this conventional construction are well known in the art as described in the following articles:

R. O. Miller and H. G. Seip, "Condensers and Heat Exchangers," *Corrosion in Power Generating Equipment,* Plenum Plublishing Corporation, 1984.

G. V. Spires, et al, "Case History: Lining Condenser Components in a Nuclear Plant," Journal of Protective Coatings and Linings, 34–41, September 1984.

In an apparatus of this type where brackish or seawater cooling are used, the ferritic stainless steel tubing is required to be resistant on one surface to pitting and crevice corrosion as well as other forms of corrosive attack in these aggressive cooling waters and on the other surface to similar forms of corrosive attack from the process media. Since welding is used in either the construction or installation or both with respect to such tubing, the tubing must exhibit good weldability and be resistant to corrosion in the as-welded, and welded and annealed conditions. Also, the toughness and ductility of the tubing in these metallurgical conditions must be sufficient to avoid cracking during the expansion of the tubing into the tubesheets and in other forming operations.

For these applications, it is known to use ferritic stainless steels containing about 20 to 30% chromium and which are stabilized by the use of titanium, columbium, zirconium, and aluminum or combinations thereof. These stabilizing elements have generally been deemed to be equivalent for this purpose.

A significant disadvantage of welded tubing made from these conventional ferritic stainless steels is the susceptibility of the tubing to hydrogen embrittlement.

This embrittlement, coupled with applied or residual stresses, can result in extensive cracking of the tubing. Hydrogen embrittlement has been found to be more pronounced in typical applications where the tubing is exposed to hydrogen sulfide or nascent hydrogen in the media being processed or where the heat exchangers are subjected to cathodic protection to minimize galvanic or crevice corrosion of the tubesheet or water box materials. As indicated in NACE Standard RP-01-69, it is conventional practice when cathodically protecting carbon steel or cast iron components in seawater cooled heat exchangers to utilize electrochemical potentials more electronegative than about −850 millivolts (SCE), whether the protection is afforded by use of sacrifical anodes or by automatic electrical systems. There is a need, therefore, for welded ferritic stainless steel tubing that exhibits high resistance to hydrogen embrittlement when exposed to process media containing hydrogen sulfide or other sources of nascent hydrogen or when used in a cathodically protected heat exchanger or condenser using brackish or seawater cooling.

SUMMARY OF THE INVENTION

It is accordingly a primary object of the present invention to provide welded tubing of a highly corrosion resistant ferritic stainless steel having high resistance to hydrogen embrittlement and when used in a heat exchanger having media containing hydrogen sulfide or nascent hydrogen, or in cathodically protected heat exchangers, particularly one operated at electrochemical potentials more negative than about −800 millivolts (SCE).

In accordance with the invention, it has been determined that welded tubing of corrosion-resistant ferritic stainless steel may satisfy the aforementioned object of the invention with a composition having lower than conventional carbon and nitrogen contents in combination with columbium stabilization and the exclusion of stabilization with titanium, combinations of titanium and columbium, zirconium or aluminum. It is also necessary that the steel contain chromium, molybdenum and nickel, with nickel and molybdenum being in amounts different from those conventionally employed in ferritic stainless steels of this type.

The welded tubing in accordance with the invention is of a ferritic stainless steel of a composition, in weight percent, carbon at least 0.002, nitrogen at least 0.002, carbon plus nitrogen 0.02 max. and preferably 0.01 to 0.02, chromium 23 to 28, preferably 25 to 28, manganese up to 1, preferably up to 0.5, nickel 1 to 4, silicon up to 1, preferably up to 0.5, phosphorus up to 0.04, sulfur up to 0.02, preferably up to 0.005, molybdenum 2 to 5, preferably 2 to 4, aluminum up to 0.1, columbium 0.60 max. with columbium being at least equal to eight times carbon plus nitrogen, and the balance iron and incidental impurities.

The welded tubing may be made by conventional autogenous welding practices wherein a continuous band of the ferritic stainless steel of a chemical composition in accordance with the invention is roll formed and autogenous welded longitudinally in a continuous fashion to produce the tubing. Conventional practices, such as tungsten-inert gas welding may be used for this purpose. For purposes of the invention and as used herein, the term "welded tubing" includes non-cylindrical shapes or hollows such as used in plate-type heat exchangers.

Carbon and nitrogen contents as low as about 0.002% each may be obtained by vacuum induction or electron-beam melting practices; whereas, carbon plus nitrogen contents as low as about 0.01% may be obtained by conventional large capacity vacuum-oxygen refining practices. As will be demonstrated by the data presented herein, the invention finds utility with welded tubing made from ferritic stainless steel melted in accordance with either of these practices and having carbon and nitrogen contents each at a minimum of 0.002% or a combined minimum of 0.01% to a maximum of 0.02%. As will be demonstrated by the data presented herein, it is not only required that stabilization be effected only by the use of columbium, but carbon and nitrogen in combination must also be closely controlled in accordance with the limits set forth herein.

Manganese is an austenite forming element and also a potent solid solution strengthening element in ferritic stainless steels. Accordingly, in accordance with the invention, manganese must be maintained below about 1% and preferably below about 0.5%. Sulfur is a common residual element in ferritic stainless steels and must be controlled to a maximum of 0.02%, and preferably below 0.005%, to avoid hot cracking and permit effective welding. Silicon improves welding from the standpoint of producing the desired fluidity in the alloy, but it is a strong solid solution strengthening element and thus must be kept below about 1%, and preferably below about 0.5%. Although nickel is a strong austenite forming element it must be present for purposes of improved weld toughness and ductility. Chromium is essential for corrosion resistance, particularly resistance to pitting and crevice corrosion in seawater and other chloride containing environments. Chromium within the limits of the invention provides the desired corrosion resistance, but higher chromium content impairs weld toughness. Molybdenum is necessary for providing the required corrosion resistance; however, if molybdenum is present in excessive amounts it introduces undesirable second phases which reduce toughness and corrosion resistance. Aluminum is an effective deoxidizing element required during the refining operation, but excessive aluminum results in problems during welding.

Columbium, as discussed, is needed to prevent weld intergranular corrosion. Excessive columbium, however, adversely affects weld toughness.

DETAILED DESCRIPTION OF THE PREFERRED EMBODIMENTS

Reference will now be made in detail to presently preferred embodiments of the invention, examples of which are described below.

Two groups of tests were conducted to evaluate the ferritic stainless steels listed in Table I with respect to properties essential to their use in brackish or seawater cooled heat exchangers and power plant condensers. One group of tests was conducted to compare the resistance of these materials to intergranular and pitting corrosion and their formability in the non-welded and welded conditions. The other group of tests was conducted to evaluate the susceptibility of the materials to hydrogen embrittlement.

Corrosion Resistance and Mechanical Properties

Two ASTM tests were used to compare the intergranular corrosion resistance of the ferritic stainless steel tubing of the invention in the as-welded condition to that of other ferritic stainless steels listed in Table I. The copper-copper sulfate-sulfuric acid test (ASTM A763, Practice Y) was used to evaluate susceptibility to intergranular corrosion associated with the precipitation of chromium carbides and/or nitrides. The ferric sulfate-sulfuric acid test (ASTM A763, Practice X) was used to evaluate susceptibility to intergranular corrosion associated with the precipitation of chromium carbides and/or nitrides and with the precipitation of chi, sigma, and other intermetallic phases. The results of the copper-copper sulfate-sulfuric acid tests on four alloys of varying columbium and molybdenum content are given in Table II. They clearly show that Alloy 37, having a base composition within the scope of invention but which contains no columbium, is susceptible to intergranular attack in the as-welded condition. The welds of the three other alloys evaluated (Alloys 15, 20, and 19) which contain an amount of columbium in excess of eight times their carbon plus nitrogen content, are resistant to intergranular attack in this solution. The results of the ferric sulfate-sulfuric acid tests are given in Table III for five alloys of different columbium and molbydenum contents. Similar to the results obtained in the copper-copper sulfate-sulfuric acid test, the results of these tests show that Alloy 37, having a base composition within the scope of the invention but which contains no columbium, is susceptible to intergranular corrosion in the as-welded condition. However, they also show that Alloy 19, which contains 4.44% molybdenum, and Alloy 18, which contains 5.34% molybdenum, are susceptible to intergranular corrosion in this test. Thus, in the ferric sulfate-sulfuric acid test, which is representative of highly oxidizing chemical media, both columbium and molybdenum contents need to be controlled to avoid intergranular corrosion. Columbium-stabilized tubing of the invention having less than about 4.00% molybdenum are resistant to intergranular corrosion in both the copper-copper sulfate-sulfuric and ferric sulfate-sulfuric acid tests, and therefore have the widest practical application. The as-welded columbium-stabilized tubing of the invention containing more than about 4.00% molybdenum is not resistant to intergranular attack in the ferric sulfate-sulfuric acid test, and therefore its use is limited in highly oxidizing chemical media.

The molybdenum content of the stainless steel tubing of the invention is also important with respect to its pitting resistance when used in heat exchangers utilizing brackish or seawater cooling. To demonstrate this, a series of tests were conducted on several of the alloys listed in Table I to compare their resistance to pitting at different temperatures in a neutral solution of substitute seawater containing 10 g/liter of potassium ferricyanide to increase its corrosivity. The results of these tests are given in Table IV. They show that the temperature needed to initiate pitting in these alloys increases with molybdenum content. More importantly, they show that to obtain good pitting resistance at the elevated temperatures commonly encountered in many heat exchanger applications (60° C.), the tubing of the invention must contain at least about 2% molybdenum, as demonstrated by the relative performance of Alloy 13 which contains 1.8% molybdenum and Alloy 14 which contains 2.69% molybdenum. Alloy 15, which is stabilized with columbium and which contains 3.51% molybdenum, was immune to pitting in these tests.

The weld ductility of several of the alloys listed in Table I were compared by making Olsen cup tests on 0.037-inch thick TIG welds and by comparing the results to those obtained from similar tests made on the annealed and unwelded base materials. The results are given in Table V. They show that the Olsen cup ductility of Alloy 7 which contains 0.41% nickel is significantly reduced by welding. In comparison, the Olsen cup ductility of the alloys containing more than about 1.0% nickel, and less than about 5.0% molybdenum as with Alloys 10, 8, 15, and 19, is as good in the as-welded condition as in the unwelded condition. Thus, for heat exchanger applications, in which the tubes are bent or mechanically expanded during installation, the nickel-bearing materials of the invention have substantial practical advantages. It is necesary, however, to restrict the molybdenum content of the nickel-bearing alloys of the invention to less than about 5% because of the formation of brittle second phases which, as shown by the performance of Alloy 18, severely reduce Olsen cup ductility in both the unwelded and welded conditions.

Hydrogen Embrittlement

Three basic methods were used to charge the test steels with hydrogen and to evaluate their susceptibilty to hydrogen embrittlement. One method involved charging materials in substitute or natural seawater for different times at various electrochemical potentials analogous to those used for cathodic protection in condensers and heat exchangers. The second method involved charging samples in a solution containing 50% hydrochloric acid (36.5 to 38.0% HCl) and 50% water by volume to which 20 gram/liter of selenium dioxide was added to promote hydrogen absorption. With these two charging practices, the susceptibility of the steels to hydrogen embrittlement was evaluated according to the ability of a sample to withstand a 180-degree bend without cracking or fissuring. The specimens withstanding a 180-degree bend without completely fracturing were considered to be highly resistant to embrittlement while those that cracked or fissured upon bending to 180° were considered to be susceptible to hydrogen embrittlement. The third method consisted of testing samples stressed in tension as three-point bent beams according to NACE Test Method 01-77 in an aqueous solution containing 5% sodium chloride and 0.5% acetic acid at ambient temperature. The test solution was deaerated for two hours with nitrogen prior to the introduction of hydrogen sulfide gas which was continuously bubbled into the test solution throughout the duration of the 30-day (720 hours) test period. Specimens that did not crack during the 30-day test period were considered to have passed the test.

Three series of electrochemical tests were conducted to compare the hydrogen embrittlement resistance of the ferritic stainless steel tubing of the invention to that of the other corrosion resistant ferritic stainless steels listed in Table I. In the initial series of tests, samples of a titanium-stabilized highly corrosion resistant ferritic stainless steel currently used in seawater cooled condensers (Alloy 9) and of a ferritic stainless steel within the scope of the invention (Alloy 15) were charged in aerated substitute seawater (ASTM D-1141-52, Formula A) at 45° C. to establish the time required at various electrochemical potentials to produce hydrogen embrittlement, as measured by a loss in bend ductility.

The results of these tests, which are given in Table VI, show that at electrochemical potentials between −700 and −800 millivolts with respect to the standard calomel electrode (SCE) essentially no embrittlement occurs with Alloy 9 for exposure times up to 100 hours. However, as the applied electrochemical potential becomes more negative than −800 millivolts (SCE), the samples of Alloy 9 become increasingly susceptible to hydrogen embrittlement, as indicated by the shorter exposure times needed to produce a loss of bend ductility. Thus, the data show that a titanium-stabilized highly corrosion resistant ferritic stainless steel of conventional composition becomes susceptible to hydrogen embrittlement at electrochemical potentials more negative than −800 millivolts (SCE). None of the samples from Alloy 15 whose composition is within the scope of the invention, showed any signs of hydrogen embrittlement when tested under several of the same test conditions.

Based on the data in Table VI, a simplified screening test was devised to further compare the resistance of the ferritic stainless steels listed in Table I to hydrogen embrittlement. The test involved measuring the bend ductility of specimens exposed for 24 hours at potentials of −1000 and/or −1200 millivolts (SCE), conditions which as indicated in Table VI embrittle a titanium-stabilized highly alloyed ferritic stainless steel of conventional composition.

As shown by the data in Table VII, only Alloy 15 which contains 0.012% carbon plus nitrogen and 0.26% columbium and Alloy 17 which contains 0.016% carbon plus nitrogen and 0.27% columbium were resistant to hydrogen embrittlement in these tests. All other alloys of similiar base composition, including Alloy 1 which contains 0.01% carbon plus nitrogen and 0.34% titanium; Alloy 30 which contains 0.020% carbon plus nitrogen, 0.16% titanium, and 0.14% columbium; and Alloy 21 which contains 0.022% carbon plus nitrogen and 0.33% columbium were susceptible to hydrogen embrittlement in this test. Thus, in accordance with this invention, the data show that a marked improvement in the resistance to hydrogen embrittlement can be obtained by lowering carbon plus nitrogen to below about 0.02% and by using columbium rather than titanium or a mixture of titanium and columbium for stabilization.

To further demonstrate the advantage of the ferritic stainless steel tubing of the invention, samples of Alloy 1 which contains 0.01% carbon plus nitrogen and 0.34% titanium; Alloy 9 which contains 0.038% carbon plus nitrogen and 0.50% titanium; and of Alloy 15 which contains 0.012% carbon plus nitrogen and 0.26% columbium were exposed for various lengths of time at different electrochemical potentials in natural flowing seawater at ambient temperature.

After being exposed at the potentials and times indicated in Table VIII, the samples were removed from the test and quickly bent 180° to determine whether they were susceptible to hydrogen embrittlement. Of the three alloys tested, only Alloy 15 was resistant to hydrogen embrittlement. Thus, the results of these tests again show that lowering carbon plus nitrogen to below about 0.02% and by using columbium rather than titanium for stabilization, as with Alloy 15, results in a substantial improvement in the resistance of highly alloyed ferritic stainless steels to hydrogen embrittlement.

Samples of the alloys listed in Table I were also compared for their susceptibility to hydrogen embrittlement by conducting bend tests on specimens which were charged for 40 minutes in a solution containing 50% hydrochloric acid (36.5 to 38.0% HCl) and 50% water by volume to which 20 gram/liter of selenium dioxide was added to promote hydrogen absorption.

The results of these tests are given in Table IX. Similar to the results presented earlier for the electrochemical tests, the only alloys (15, 16, 17, 20) that were resistant to hydrogen embrittlement in this test were the columbium-stabilized alloys containing less than about 0.02% carbon plus nitrogen. All the other alloys evaluated including columbium-stabilized alloys containing more than about 0.020% carbon plus nitrogen (Alloys 21 and 22), titanium-stabilized alloys containing as little as 0.010 carbon plus nitrogen (Alloy 1), and alloys stabilized with both columbium and titanium and containing 0.020% carbon plus nitrogen were susceptible to hydrogen embrittlement in these tests. Titanium-stabilized alloys with chromium and molybdenum contents insufficient for use in seawater (Alloys 12) or sufficient for use in seawater (Alloy 7) were also subject to embrittlement in these tests. Thus, these results again demonstrate that for highly corrosion resistant ferritic stainless steels improved resistance to hydrogen embrittlement can be obtained only by lowering carbon plus nitrogen content to below about 0.02% and using columbium for stabilization rather than titanium alone, or mixtures of columbium, titanium or aluminum.

One additional series of chemical charging tests were conducted on samples of Alloy 15 and Alloy 9 in the as-annealed, as-welded, and welded and annealed conditions to determine the effect of TIG welding on their resistance to hydrogen embrittlement. The results of these tests, which are given in Table X, show that welding does not significantly change the resistance of these alloys to hydrogen-embrittlement. Alloy 15, having a composition within the scope of the invention, remains resistant to hydrogen embrittlement after welding; whereas Alloy 9 with a composition outside the claims of the invention remains susceptible to hydrogen embrittlement after welding.

The results of the three-point bend beam tests conducted according to NACE Test Method 01-77 on a conventional titanium-stabilized ferritic stainless steel (Alloy 11) and on a columbium-stabilized ferritic stainless steel (Alloy 15) having a composition within the scope of the invention are given in Table XI. Here, it can be seen that Alloy 15 is totally resistant to cracking when stressed in tension up to 75 ksi; whereas, Alloy 11 having a composition outside the claims of the invention fails when stressed to as little as 15 ksi in tension. Thus, the results show that in hydrogen sulfide containing environments, the resistance of highly corrosion resistant ferritic stainless steels to hydrogen embrittlement in such environment can be markedly improved by using columbium stabilization and by controlling carbon and nitrogen within the limits of the invention.

As may be seen from the above test results maintaining carbon plus nitrogen within the limits of the invention or stabilizing by the use of columbium alone in accordance with the invention will not achieve the desired resistance to hydrogen embrittlement. It is necessary that control of carbon plus nitrogen within the limits of the invention in combination with columbium stabilization be used.

TABLE I

| | | | Chemical Composition of Experimental Materials | | | | | | | | | | | |
|---|---|---|---|---|---|---|---|---|---|---|---|---|---|---|
| Material | C | N | Mn | P | S | Si | Ni | Cr | Mo | Ti | Cb | Cu | Al | C + N |
| | | | | | | Alloys Titanium Stabilized | | | | | | | | |
| 1 | .002 | .008 | .16 | .024 | .003 | .25 | 1.85 | 26.92 | 3.34 | .34 | — | .005 | .005 | .010 |
| 2 | .009 | .015 | .73 | .016 | .006 | .42 | 2.25 | 26.95 | 3.67 | .43 | — | .11 | .02 | .024 |
| 3 | .019 | .008 | .24 | .016 | .005 | .29 | 2.01 | 27.85 | 3.37 | .30 | — | — | .05 | .027 |
| 4 | .014 | .016 | .12 | .020 | .030 | .25 | 0.25 | 25.61 | 0.95 | .49 | — | .04 | .02 | .030 |
| 5 | .010 | .023 | .70 | .017 | .006 | .45 | 1.98 | 27.00 | 3.56 | .42 | — | .12 | .05 | .033 |
| 6 | .019 | .014 | .38 | | | .32 | 4.10 | 24.54 | 3.89 | .41 | — | | | .033 |
| 7 | .016 | .020 | .29 | .027 | .002 | .18 | 0.41 | 28.32 | 3.68 | .68 | — | | .07 | .036 |
| 8 | .015 | .022 | .35 | .021 | .004 | .20 | 2.06 | 27.16 | 3.36 | .54 | — | .15 | .08 | .037 |
| 9 | .018 | .020 | .30 | .024 | .002 | .21 | 1.88 | 27.30 | 3.42 | .50 | — | | | .038 |
| 10 | .029 | .012 | .31 | .027 | .001 | .41 | 1.26 | 27.05 | 3.39 | .45 | — | .12 | .07 | .041 |
| 11 | .018 | .025 | .26 | .021 | .001 | .40 | 1.99 | 27.00 | 3.40 | .44 | — | — | — | .043 |
| 12 | .018 | .029 | .28 | .017 | — | .38 | 0.23 | 25.91 | 0.98 | .56 | — | .13 | .05 | .047 |
| 13 | .021 | .026 | .28 | .020 | .013 | .55 | 0.22 | 26.09 | 1.81 | .45 | — | .12 | — | .047 |
| 14 | .024 | .029 | .29 | .023 | — | .46 | 0.21 | 25.63 | 2.69 | .41 | — | .13 | .04 | .053 |
| | | | | | | Alloys Columbium Stabilized | | | | | | | | |
| 15 | .006 | .006 | .36 | .025 | .001 | .33 | 1.92 | 26.90 | 3.51 | — | .26 | .06 | .09 | .012 |
| 16 | .006 | .006 | .25 | .020 | .003 | .28 | 1.98 | 27.64 | 3.48 | — | .48 | | .05 | .012 |
| 17 | .009 | .007 | .20 | .020 | .005 | .26 | 2.03 | 27.70 | 3.51 | — | .27 | | .09 | .016 |
| 18 | .007 | .008 | .20 | .010 | .005 | .25 | 2.02 | 27.18 | 5.34 | — | .37 | — | .05 | .015 |
| 19 | .009 | .008 | .25 | .020 | .003 | .26 | 2.02 | 27.32 | 4.44 | — | .37 | — | .06 | .017 |
| 20 | .010 | .009 | .21 | .020 | .006 | .27 | 1.97 | 27.39 | 3.50 | — | .36 | | .10 | .019 |
| 21 | .014 | .008 | .25 | .020 | .005 | .25 | 2.06 | 27.81 | 3.53 | — | .33 | | .08 | .022 |
| 22 | .015 | .009 | .21 | .020 | .005 | .25 | 2.04 | 27.68 | 3.47 | — | .32 | | .07 | .024 |
| 23 | .013 | .015 | .24 | .016 | .004 | .26 | 2.00 | 28.13 | 3.48 | — | .46 | | .02 | .028 |
| 24 | .009 | .019 | .25 | .015 | .006 | .25 | 2.00 | 27.51 | 3.49 | — | .47 | | .02 | .028 |
| 25 | .018 | .014 | .25 | .018 | .006 | .29 | 2.00 | 27.90 | 3.40 | — | .34 | | .04 | .032 |
| 26 | .020 | .017 | .26 | .020 | .004 | .28 | 2.05 | 27.37 | 3.52 | — | .32 | | .23 | .037 |
| 27 | .027 | .018 | .23 | .015 | .003 | .25 | 1.99 | 27.90 | 3.50 | — | .46 | | .01 | .045 |
| 28 | .021 | .025 | .22 | .020 | .004 | .26 | 2.03 | 27.84 | 3.50 | — | .33 | | .09 | .046 |
| 29 | .029 | .035 | .23 | .016 | .003 | .24 | 1.99 | 28.00 | 3.50 | — | .47 | | .04 | .064 |
| | | | | | | Alloys Titanium and Columbium Stabilized | | | | | | | | |
| 30 | .014 | .006 | .23 | .022 | .006 | .29 | 2.04 | 27.80 | 3.41 | .16 | .14 | | .05 | .020 |
| 31 | .027 | .024 | .37 | .032 | .005 | .46 | 2.03 | 27.30 | 3.49 | .29 | .44 | | .02 | .051 |
| 32 | .029 | .022 | .38 | .033 | .005 | .47 | 2.03 | 27.29 | 3.49 | .12 | .44 | | .04 | .051 |
| 32 | .029 | .022 | .38 | .033 | .005 | .47 | 2.03 | 27.29 | 3.49 | .12 | .44 | | .04 | .051 |
| 33 | .027 | .025 | .36 | .033 | .005 | .43 | 2.03 | 27.40 | 3.49 | .20 | .43 | | .04 | .052 |
| 34 | .002 | .032 | .28 | .023 | .001 | .33 | 0.27 | 28.65 | 3.79 | .33 | .17 | | | .054 |
| 35 | .030 | .028 | .23 | .015 | .003 | .25 | 1.99 | 27.80 | 3.50 | .27 | .27 | | .03 | .058 |

TABLE I-continued

| Material | C | N | Mn | P | S | Si | Ni | Cr | Mo | Ti | Cb | Cu | Al | C + N |
|---|---|---|---|---|---|---|---|---|---|---|---|---|---|---|
| | Chemical Composition of Experimental Materials | | | | | | | | | | | | | |
| | Alloys Not Stabilized | | | | | | | | | | | | | |
| 36 | .003 | .010 | — | .010 | .007 | .27 | 0.17 | 26.99 | 0.97 | — | — | .01 | — | .013 |
| 37 | .008 | .007 | .19 | .020 | .005 | .26 | 2.02 | 27.72 | 3.55 | — | — | — | .05 | .015 |

TABLE II

Intergranular Corrosion Resistance of Welded Alloys in the Copper-Copper Sulfate-Sulfuric Acid (ASTM A763, Practice Y) Test[a]

| Material | C + N | Cr | Mo | Cb | Grain Drop Out Severity Base | Weld | HAZ[b] |
|---|---|---|---|---|---|---|---|
| 37 | 0.015 | 27.27 | 3.55 | — | none | moderate | moderate |
| 15 | 0.012 | 26.90 | 3.51 | 0.26 | none | none | none |
| 20 | 0.019 | 27.39 | 3.50 | 0.36 | none | none | none |
| 19 | 0.017 | 27.32 | 4.50 | 0.37 | none | none | none |

[a]Samples TIG welded without filler metal at a thickness of 0.037-inch
[b]HAZ — heat affected zone

TABLE III

Intergranular Corrosion Resistance of Welded Alloys in the Ferric Sulfate-Sulfuric Acid (ASTM A763, Practice X) Test[a]

| Material | C + N | Cr | Mo | Cb | Grain Drop Out Severity Base | Weld | HAZ[b] |
|---|---|---|---|---|---|---|---|
| 37 | 0.015 | 27.27 | 3.55 | — | none | light | moderate |
| 15 | 0.012 | 26.90 | 3.51 | 0.26 | none | none | none |
| 20 | 0.019 | 27.39 | 3.50 | 0.36 | none | none | none |
| 19 | 0.017 | 27.32 | 4.44 | 0.37 | none | none | light |
| 18 | 0.016 | 27.18 | 5.34 | 0.37 | none | light | light |

[a]Samples TIG welded without filler metal at a thickness of 0.037-inch
[b]HAZ — heat affected zone

TABLE IV

Pitting Resistance of Various Alloys in Neutral Substitute Seawater Containing 10 gram/liter of Potassium Ferricyanide[a]

| Material | C + N | Cr | Ni | Mo | Ti | Cb | Severity of Pitting 40° C. | 60° C. |
|---|---|---|---|---|---|---|---|---|
| 36 | 0.013 | 26.99 | 0.17 | 0.97 | — | — | none | moderate |
| 12 | 0.047 | 25.61 | 0.23 | 0.99 | 0.56 | — | none | moderate |
| 13 | 0.047 | 26.09 | 0.22 | 1.81 | 0.45 | — | none | light |
| 14 | 0.053 | 25.63 | 0.21 | 2.69 | 0.41 | — | none | none |
| 15 | 0.012 | 26.90 | 1.92 | 3.51 | — | 0.26 | none | none |
| 19 | 0.017 | 27.32 | 2.02 | 4.44 | — | 0.37 | none | none |

[a]Tests conducted for 24 hours in neutral substitute seawater containing 10 gram/-liter $K_3Fe(CN)_6$

TABLE V

Effect of Nickel Content on the Olsen Cup Ductility of Various Unwelded and TIG-Welded Ferritic Stainless Steels[a]

| Material | C + N | Cr | Ni | Mo | Ti | Cb | Olsen Cup Height in.[b] Unwelded | As-welded |
|---|---|---|---|---|---|---|---|---|
| 7 | 0.036 | 28.32 | 0.41 | 3.65 | 0.68 | — | 0.306 | 0.143 |
| 10 | 0.041 | 27.05 | 1.26 | 3.39 | 0.45 | — | 0.336 | 0.347 |
| 8 | 0.037 | 27.16 | 2.06 | 3.36 | 0.54 | — | 0.298 | 0.301 |
| 15 | 0.012 | 26.90 | 1.92 | 3.51 | — | 0.26 | 0.340 | 0.340 |
| 19 | 0.017 | 27.32 | 2.02 | 4.44 | — | 0.37 | 0.317 | 0.338 |
| 18 | 0.016 | 27.18 | 2.20 | 5.34 | — | 0.37 | 0.205 | 0.115 |

[a]Samples TIG-welded wihtout filler metal at a thickness of 0.037-inch
[b]Maximum cup height without failure

TABLE VI

Effect of Cathodic Charging Potential and Time on the Bend Ductility (Embrittlement) of Alloy 9 in Substitute Seawater

| Potential (Millivolts vs. SCE) | Charging Time (Hours) 1 | 1.5 | 2 | 3 | 5 | 16 | 48 | 68 | 100 | 120 | 750 |
|---|---|---|---|---|---|---|---|---|---|---|---|
| 700 | P[a] | — | — | — | P | — | P | P | — | P | P |
| 800 | P | — | — | — | — | P | — | P | P | — | |
| 850 | P | — | — | — | P | F | — | F | — | — | — |
| 900 | P | — | — | — | F | F | — | — | — | — | — |
| 1000 | P | P | P | F | — | F | — | — | — | — | — |
| 1100 | P | F | — | | | | | | | | |
| 1200 | F | F | — | | | | | | | | |
| 1400 | F | F | — | | | | | | | | |

[a]P - pass 180° bend test, F - failed 180° bend test

TABLE VII

Embrittlement of Samples Charged for 24 Hours at Indicated Potentials in Substitute Seawater at 45° C. (115° F.)[a]

| Materials | C + N | Cr | Mo | Ni | Ti | Cb | Al | Applied Potential (Millivolts) −1000 | −1200 |
|---|---|---|---|---|---|---|---|---|---|
| 1 | 0.010 | 26.92 | 3.34 | 1.85 | 0.34 | — | .005 | — | F |
| 2 | 0.024 | 26.95 | 3.67 | 2.25 | 0.43 | — | .02 | F | F |
| 3 | 0.027 | 27.85 | 3.37 | 2.01 | 0.30 | — | .05 | F | F |
| 6 | 0.033 | 24.54 | 3.89 | 4.10 | 0.41 | — | .07 | F | F |
| 7 | 0.036 | 28.32 | 3.89 | 0.41 | 0.68 | — | — | — | F |
| 9 | 0.038 | 27.30 | 3.42 | 1.88 | 0.50 | — | — | F | F |
| 30 | 0.020 | 27.80 | 3.41 | 2.04 | 0.16 | 0.14 | 0.5 | F | — |
| 31 | 0.051 | 27.30 | 3.49 | 2.03 | 0.29 | 0.44 | .02 | F | — |
| 32 | 0.051 | 27.29 | 3.49 | 2.03 | 0.12 | 0.44 | .04 | — | F |
| 34 | 0.058 | 28.65 | 3.79 | 0.27 | 0.33 | 0.17 | — | F | — |
| 15 | 0.012 | 26.90 | 3.51 | 1.92 | — | 0.26 | .09 | P | P |
| 17 | 0.016 | 27.70 | 3.51 | 2.03 | — | 0.27 | .09 | P | P |
| 20 | 0.019 | 27.39 | 3.50 | 1.97 | — | 0.36 | .10 | P | P |
| 21 | 0.022 | 27.81 | 3.53 | 2.06 | — | 0.33 | .08 | — | F |

TABLE VII-continued

Embrittlement of Samples Charged for 24 Hours at Indicated Potentials in Substitute Seawater at 45° C. (115° F.)[a]

| Materials | C + N | Cr | Mo | Ni | Ti | Cb | Al | Applied Potential (Millivolts) −1000 | −1200 |
|---|---|---|---|---|---|---|---|---|---|
| 22 | 0.024 | 27.68 | 3.47 | 2.04 | — | 0.32 | .07 | F | F |
| 25 | 0.032 | 27.90 | 3.40 | 2.00 | — | 0.34 | .04 | — | F |
| 28 | 0.046 | 27.84 | 3.50 | 2.03 | — | 0.33 | .09 | — | F |

[a]Samples bent 180° F. after charging; F — Failed, P — Pass

TABLE VIII

Embrittlement of Specimens Charged at Indicated Electrochemical Potentials in Natural Filtered Flowing Seawater at Ambient Temperature[a]

| Material | C + N | Ti | Cb | Charging Potentials (Millivolts vs. SCE) −850 | −1000 | −1200 | −1400 | −2000 |
|---|---|---|---|---|---|---|---|---|
| 1 | 0.010 | 0.34 | — | F (4.7 days) | F (4.7 days) | F (4.7 days) | — | — |
| | | | | — | F (11.6 days) | F (11.6 days) | — | — |
| 9 | 0.038 | 0.50 | — | — | F (3 days) | — | F (3 days) | F (3 days) |
| | | | | F (11.6 days) | F (11.6 days) | F (11.6 days) | — | — |
| 15 | 0.012 | — | 0.26 | — | P (3 days) | — | P (3 days) | P (28 days) |
| | | | | — | P (14 days) | — | — | P (14 days) |
| | | | | — | P (28 days) | — | P (28 days) | P (28 days) |

[a]Samples bent 180° F. after indicated exposures; F — Failed, P — Pass

TABLE IX

Embrittlement of Samples Charged Chemically for 40 Minutes in Hydrochloric Acid Test Solution Containing 50% Hydrochloric Acid Plus 50% Water to Which 20 g/liter Selenium Dioxide Was Added

| Material | C + N | Cr | Mo | Ni | Ti | Cb | 180° Bend Test |
|---|---|---|---|---|---|---|---|
| 1 | 0.010 | 26.92 | 3.34 | 1.85 | 0.34 | — | F (fail) |
| 2 | 0.024 | 26.95 | 3.67 | 2.25 | 0.43 | — | F |
| 3 | 0.027 | 27.85 | 3.37 | 2.01 | 0.30 | — | F |
| 4 | 0.030 | 25.61 | 0.95 | 0.25 | 0.49 | — | F |
| 5 | 0.033 | 27.00 | 3.56 | 1.98 | 0.42 | — | F |
| 6 | 0.033 | 24.54 | 3.89 | 4.10 | 0.41 | — | F |
| 7 | 0.036 | 28.32 | 3.89 | 0.41 | 0.68 | — | F |
| 8 | 0.037 | 27.16 | 3.36 | 2.06 | 0.54 | — | F |
| 9 | 0.038 | 27.30 | 3.42 | 1.88 | 0.50 | — | F |
| 10 | 0.041 | 27.30 | 3.42 | 1.88 | 0.50 | — | F |
| 30 | 0.020 | 27.80 | 3.41 | 2.04 | 0.16 | 0.14 | F |
| 31 | 0.051 | 27.30 | 3.49 | 2.03 | 0.29 | 0.44 | F |
| 32 | 0.051 | 27.29 | 3.49 | 2.03 | 0.12 | 0.44 | F |
| 33 | 0.052 | 27.40 | 3.49 | 2.03 | 0.20 | 0.43 | F |
| 34 | 0.054 | 28.65 | 3.79 | 0.27 | 0.33 | 0.17 | F |
| 35 | 0.058 | 27.80 | 3.50 | 1.99 | 0.27 | 0.27 | F |
| 15 | 0.012 | 26.90 | 3.51 | 1.92 | — | 0.26 | P(pass) |
| 16 | 0.012 | 27.64 | 3.48 | 1.98 | — | 0.48 | P |
| 17 | 0.016 | 27.70 | 3.51 | 2.03 | — | 0.27 | P |
| 20 | 0.019 | 27.39 | 3.50 | 1.97 | — | 0.36 | P |
| 21 | 0.022 | 27.81 | 3.53 | 2.06 | — | 0.33 | F |
| 23 | 0.028 | 28.13 | 3.48 | 2.00 | — | 0.46 | F |
| 24 | 0.028 | 27.51 | 3.49 | 2.00 | — | 0.47 | F |
| 25 | 0.032 | 27.90 | 3.40 | 2.00 | — | 0.34 | F |
| 26 | 0.037 | 27.37 | 3.52 | 2.05 | — | 0.32 | F |
| 27 | 0.045 | 27.90 | 3.50 | 1.99 | — | 0.46 | F |
| 28 | 0.046 | 27.84 | 3.50 | 2.03 | — | 0.33 | F |

TABLE IX-continued

Embrittlement of Samples Charged Chemically for 40 Minutes in Hydrochloric Acid Test Solution Containing 50% Hydrochloric Acid Plus 50% Water to Which 20 g/liter Selenium Dioxide Was Added

| Material | C + N | Cr | Mo | Ni | Ti | Cb | 180° Bend Test |
|---|---|---|---|---|---|---|---|
| 29 | 0.064 | 28.00 | 3.50 | 1.99 | — | 0.47 | F |

TABLE X

Embrittlement of Welded Samples Charged Chemically 40 Minutes in Hydrochloric Acid Test Solution[a]

| Material | Metallurgical Condition | C + N | Cr | Mo | Ni | Ti | Cb | 180° Bend Test |
|---|---|---|---|---|---|---|---|---|
| 9 | Cold Rolled and Annealed | 0.038 | 27.30 | 3.42 | 1.88 | 0.50 | — | F (Fail) |
| | As-welded | | | | | | | F |
| | Welded and Annealed | | | | | | | F |
| 15 | Cold Rolled and Annealed | 0.012 | 26.90 | 3.51 | 1.92 | — | 0.26 | P (Pass) |
| | As-welded | | | | | | | P |
| | Welded and Annealed | | | | | | | P |

[a]Tests conducted on cold-rolled and annealed 0.037-inch thick strip which was TIG-welded without filler metal

TABLE XI

Results of Three-point Bent Beam Tests on Alloys 11 and 15 in the NACE TM-01-77 Test

| Material | Stress Level (ksi) | Exposure Time (hours) | Microscopic Examination of Samples |
|---|---|---|---|
| 11 | 15 | 720[1] | Cracks |
| | 30 | 720 | No cracks |
| | 45 | 720 | Cracks |
| | 60 | 720 | Cracks |
| | 75 | (150) | Broke in test |
| 15 | 15 | 720 | No cracks |
| | 30 | 720 | No cracks |
| | 45 | 720 | No cracks |
| | 60 | 720 | No cracks |
| | 75 | 720 | No cracks |

[1]Numbers without parenthesis indicate specimens did not fracture, 30 days exposure. Numbers in parenthesis indicate specimen fractured at the approximate time (+/− 50 hours) shown.

What is claimed is:

1. Welded tubing of corrosion-resistant ferritic stainless steel and characterized by high-resistance to hydrogen embrittlement, said steel consisting essentially of, in weight percent,
carbon at least 0.002,
nitrogen at least 0.002,
carbon plus nitrogen 0.02 max.,
chromium 23 to 28,
manganese up to 1,
nickel 1 to 4,
silicon up to 1,
phosphorus up to 0.04,
sulfur up to 0.02,
molybdenum 2 to 5,
aluminum up to 0.1,
columbium 0.6 max. with columbium being at least equal to eight times carbon plus nitrogen, and balance iron and incidental impurities.

2. The tubing of claim 1 wherein the carbon plus nitrogen content is 0.01 to 0.02.

3. The tubing of claim 1 or claim 2 wherein the molybdenum content is 2 to 4.

4. The tubing of claim 3 wherein the sulfur content is up to 0.005.

5. The tubing of claim 4 wherein the chromium content is 25 to 28.

6. The tubing of claim 1 or claim 2 wherein
the chromium content is 25 to 28,
the manganese content is up to 0.5,
the silicon content is up to 0.5,
the sulfur content is up to 0.005, and
the molybdenum content is 2 to 4.

7. A cathodically protected heat exchanger fitted with welded corrosion-resistant ferritic stainless steel tubing having high resistance to hydrogen embrittlement, said stainless steel tubing consisting essentially of, in weight percent,
carbon at least 0.002,
nitrogen at least 0.002,
carbon plus nitrogen 0.02 max.,
chromium 23 to 28,
manganese up to 1,
nickel 1 to 4,
silicon up to 1,
phosphorus up to 0.04,
sulfur up to 0.02,
molybdenum 2 to 5,
aluminum up to 0.1,
columbium 0.6 max. with columbium being at least equal to eight times carbon plus nitrogen, and balance iron and incidental impurities.

8. The tubing of claim 7 wherein the carbon plus nitrogen content is 0.01 to 0.02.

9. The tubing of claim 7 or claim 8 wherein the molybdenum content is 2 to 4.

10. The tubing of claim 9 wherein the sulfur content is up to 0.005.

11. The tubing of claim 10 wherein the chromium content is 25 to 28.

12. The tubing of claim 7 or claim 8 wherein
the chromium content is 25 to 28,
the manganese content is up to 0.5,
the silicon content is up to 0.5,
the sulfur content is up to 0.005, and
the molybdenum content is 2 to 4.

13. A cathodically protected heat exchanger operated at electrochemical potentials more negative than about −800 millivolts (SCE) and fitted with welded corrosion-resistant stainless steel tubing having high resistance to hydrogen embrittlement, said tubing consisting essentially of, in weight percent,
carbon at least 0.002,
nitrogen at least 0.002,
carbon plus nitrogen 0.02 max.,
chromium 23 to 28,
manganese up to 1,
nickel 1 to 4,
silicon up to 1,
phosphorus up to 0.04,
sulfur up to 0.02,
molybdenum 2 to 5,
aluminum up to 0.1,
columbium 0.6 max. with columbium being at least equal to eight times carbon plus nitrogen, and balance iron and incidental impurities.

14. The tubing of claim 13 wherein the carbon plus nitrogen content is 0.01 to 0.02.

15. The tubing of claim 13 or claim 14 wherein the molybdenum content is 2 to 4.

16. The tubing of claim 15 wherein the sulfur content is up to 0.005.

17. The tubing of claim 16 wherein the chromium content is 25 to 28.

18. The tubing of claim 13 or claim 14 wherein
the chromium content is 25 to 28,
the manganese content is up to 0.5,
the silicon content is up to 0.5,
the sulfur content is up to 0.005, and
the molybdenum content is 2 to 4.

19. A heat exchanger handling chemical media containing hydrogen sulfide or nascent hydrogen and fitted with welded corrosion-resistant ferritic stainless steel tubing having high resistance to hydrogen embrittlement, said tubing consisting essentially of, in weight percent,
carbon at least 0.002,
nitrogen at least 0.002,
carbon plus nitrogen, 0.02 max.,
chromium 23 to 28,
manganese up to 1,
nickel 1 to 4,
silicon up to 1,
phosphorus up to 0.04,
sulfur up to 0.02,
molybdenum 2 to 5,
aluminum up to 0.1,
columbium 0.6 max. with columbium being at least equal to eight times carbon plus nitrogen, and balance iron and incidental impurities.

20. The tubing of claim 19 wherein the carbon plus nitrogen content is 0.01 to 0.02.

21. The tubing of claim 19 or claim 20 wherein the molybdenum content is 2 to 4.

22. The tubing of claim 21 wherein the sulfur content is up to 0.005.

23. The tubing of claim 22, wherein the chromium content is 25 to 28.

24. The tubing of claim 19 or claim 20 wherein
the chromium content is 25 to 28,
the manganese content is up to 0.5,
the silicon content is up to 0.5,
the sulfur content is up to 0.005, and
the molybdenum content is 2 to 4.

* * * * *